United States Patent [19]

Graham, Jr.

[11] 4,139,113

[45] Feb. 13, 1979

[54] PANEL FASTENING DEVICE

[75] Inventor: Andrew S. Graham, Jr., Wyncote, Pa.

[73] Assignee: Fleck Industries, Inc., Willow Grove, Pa.

[21] Appl. No.: 693,411

[22] Filed: Jun. 7, 1976

[51] Int. Cl.[2] ..... B65D 9/12

[52] U.S. Cl. ..... 217/12 R; 52/105; 206/459; 217/65; 217/69

[58] Field of Search ..... 217/65, 69, 12 R, 43 R, 217/13, 66, 67, 68; 229/47; 220/4 F; 46/16, 19, 20; 52/105; 292/253; 206/459

[56] References Cited

U.S. PATENT DOCUMENTS

| | | | |
|---|---|---|---|
| 2,006,657 | 7/1935 | Smith | 217/69 |
| 2,121,394 | 6/1938 | Carew | 229/47 |
| 2,153,122 | 4/1939 | Powell | 229/47 |
| 2,225,592 | 12/1940 | MacFadden | 217/69 |
| 2,266,181 | 12/1941 | Epps | 190/37 |
| 2,896,808 | 7/1959 | Papy et al. | 217/69 |
| 3,082,897 | 3/1963 | Highley | 217/69 |
| 3,323,674 | 6/1967 | Nist, Jr. | 217/65 |
| 3,468,094 | 9/1969 | Campbell | 52/105 |
| 3,477,184 | 11/1969 | Johnson et al. | 52/105 |
| 3,990,599 | 11/1976 | Rowley | 217/65 |

FOREIGN PATENT DOCUMENTS

| | | | |
|---|---|---|---|
| 239677 | 4/1960 | Australia | 217/65 |
| 1219365 | 5/1960 | France | 217/69 |

*Primary Examiner*—William Price
*Assistant Examiner*—Allan N. Shoap
*Attorney, Agent, or Firm*—Charles H. Lindrooth

[57] ABSTRACT

A fastening system for structures such as knock-down crates and other multiple panel structures is disclosed. Resilient spring clips prebent to form two angularly disposed arms are provided for releasably locking panels such as the rectangular sides, ends, tops, and base panels of a knock-down shipping container. Each clip has a bent over end on one arm forming a hook adapted to fit into and to be held within a retaining slot in a bracket carried on one panel and further has a detent formed at the end of the other arm adapted to fit within an opening in a bracket on the adjacent panel to resiliently lock the panels in place when the clip is flexed.

4 Claims, 10 Drawing Figures

PANEL FASTENING DEVICE

FIELD OF THE INVENTION

This invention relates to fastening means involving the use of spring clips for use in assembling knock-down containers and other structures.

BACKGROUND OF THE INVENTION

Although not limited thereto, the invention is particularly applicable to the assembling of large crates of the type used as shipping containers for shipping furniture, household effects and the like. Various fastening means have been employed in the past in order to improve upon and facilitate the reuse of shipping containers and other knock-down structures. One fastening system which lends itself to use on knock-down containers is shown in U.S. Pat. No. 2,896,808, with a modification of that arrangement being shown in U.S. Pat. No. 2,998,154. The fastening systems disclosed in these patents use band strap fasteners, formed of flexible metal for securing panels together and have means for securing the straps including permanently deformable metal clips for sealing the band straps to metal brackets provided at the corners of the containers. When it is desired to open a container or to disassemble it, the straps are simply cut, removed and discarded. When the container is reassembled, new straps are provided and clipped in place.

In accordance with another system more recently employed, prebent spring clips are used in place of the flexible metal strips. Each clip has a detent portion preformed on each end. The detent portions interengage with detent retaining edges of openings in brackets on the corners of the container panels and resiliently lock the container panels in assembled relationship. Each spring detent end fits within a predrilled recess in the panel underlying the retaining edge formed by the hole in each bracket.

One drawback of the arrangement just described is that it requires that clearance holes be drilled in all panels of the container underneath the detent portions of each spring clip. Another drawback with the use of these spring clips is that there is no easy way of retaining the clips within one of the recesses during assembly prior to locking the panels together. This presents an awkward and time consuming assembly problem in the case of large sized knock-down crates which are typically 6" × 8" × 8" since one man cannot jockey the heavy panels into position and then simultaneously hold them in position, position the clips and lock them in place. A still further problem often arises when the containers are stored or used outside in wet or cold weather since water accumulates in the drilled recesses in the tops of the containers and will cause corrosion of the spring clips and swelling of the wood. If the weather is cold, the water will freeze in the recesses and make assembly or disassembly difficult if not impossible.

SUMMARY AND OBJECTS OF THE INVENTION

An important object of the invention is the provision of an improved releasable fastening system for joining the panels of knock-down containers and the like.

A further object of the invention is the provision of spring clip type fastening means for panels wherein the clips have means for retaining them in position on one panel prior to actual positioning of the panels to be secured together in assembled relationship.

A still further object of the invention is the provision of a fastener system which simplifies construction, assembly and disassembly of knock-down containers and similar structures.

A still further object of the invention is the provision of a fastening system which is provided with means for simply and effectively accommodating panels of a variety of thicknesses.

The foregoing and various other objects of the invention are achieved in a system for joining angularly positioned panels along a joint edge which comprises resilient spring clips preferably prebent into two angularly disposed arms which are at an angle different from the angle of the joint edge when the clips are unflexed and which are capable of being flexed to positions in which the bend angle of the arms is substantially the same as the angle of the joint when the clip is flexed. Means are provided on one panel adjacent the joint defining a slot for retaining a hooking means formed on the end of one of the arms of the clips. Interengable detent parts are provided on the end of the other of the arms and on the other panel of the joint for resiliently locking the panels in place when the clips are flexed over the joint with the hooks in the slots and the detent parts interengaged.

How the foregoing and various other objects of the invention are achieved will become apparent upon reference to the following detailed description of the illustrative embodiment of the invention, as shown in the accompanying drawings, in which.

Figure 3:
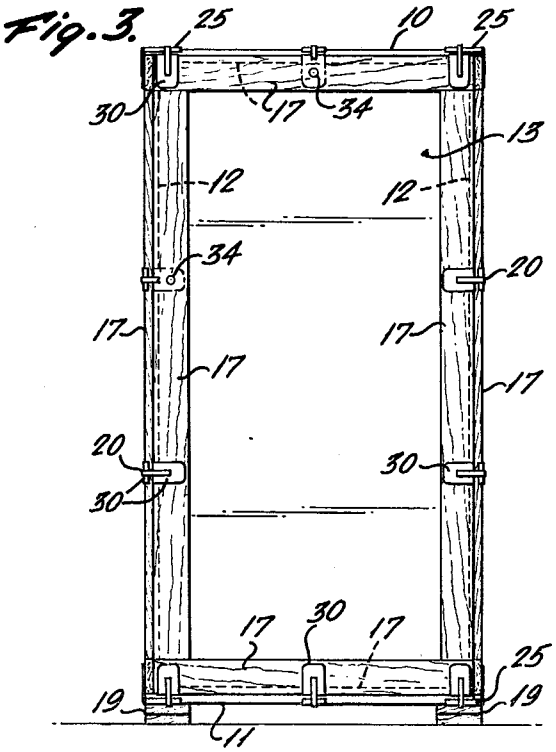
FIG. 3 is an end view of the container shown in FIGS. 1 and 2.
Figure 2:
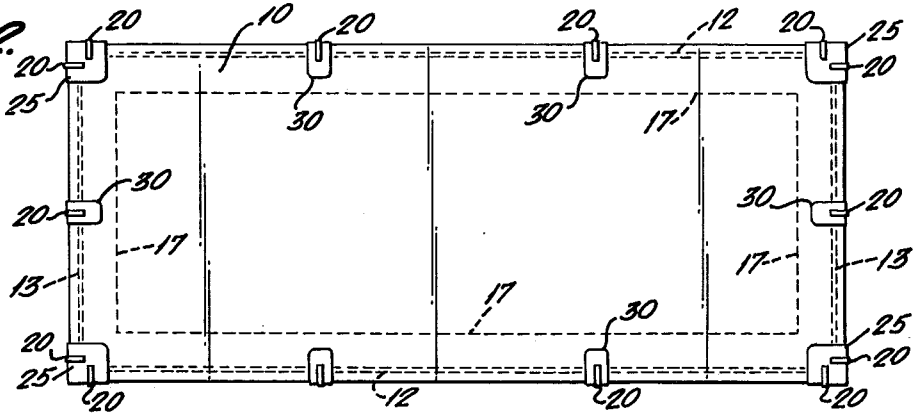
FIG. 2 is a top view of the container shown in FIG. 1.
Figure 1:
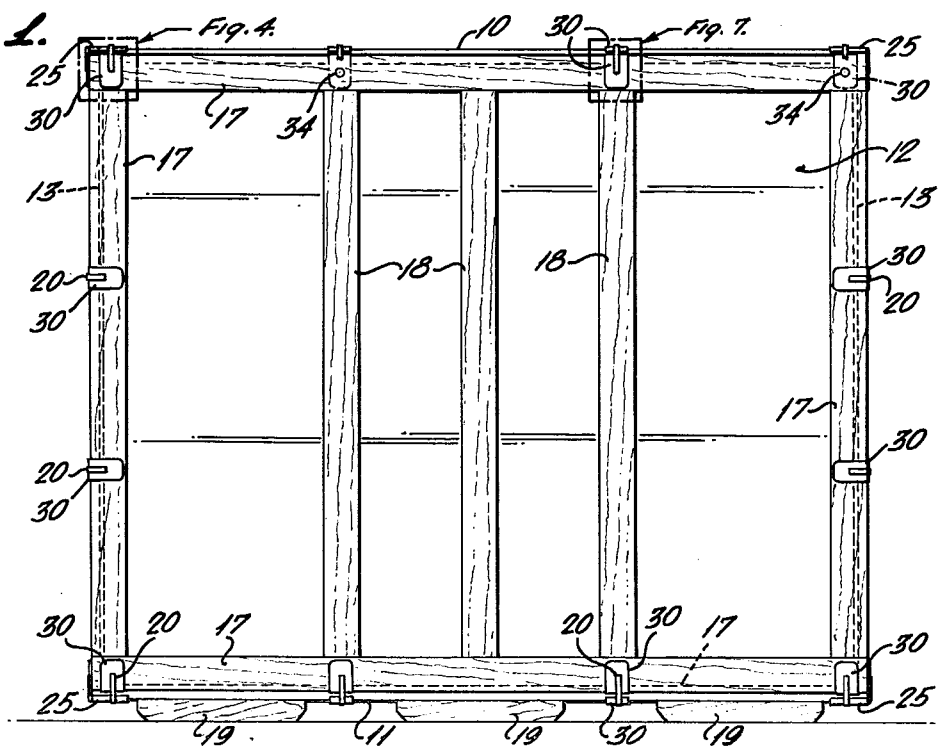
FIG. 1 is an elevational view showing a typical container assembled with a fastening system incorporating the invention.

Reference is first directed to FIGS. 1 through 3, which show, as a typical application for the invention, a knock-down crate of the type used for the shipment of household goods. Construction specifications for crates of this type have become well standardized. When such crates are supplied to the federal government, the government specifications call for a ½" thick plywood panel as shown at 10 for the tops of the container, ⅝" thick panels 11 for the bottom and ⅜" thick panels 12 and 13 for the sides and ends. The containers are framed and reinforced by batten boards 17 and side reinforcing strips 18. Suitable supports 19 are secured to the bottom of the containers to hold the containers above ground level so as to facilitate pickup by a forklift truck or other suitable cargo handling means.

As indicated above, the invention provides improved means for facilitating the assembly and disassembly of these containers so that a container can be easily reused, stored compactly when not in use and shipped to various points for use without taking up excessive valuable cargo space. In accordance with the preferred form of the invention, it is contemplated that the fastening system be comprised of two forms of similarly constructed brackets, one type of which is used on the top and bottom panels at the corners of a structure and the other along the sides and ends at the corners as well as at points intermediate the corners. The corner and side brackets secure the panels together by the use of a novel form of spring clip which may be fastened to a bracket on one panel prior to assembly and snapped into an opening in the other bracket when the panels are properly positioned to lock the panels together.

Figure 8:
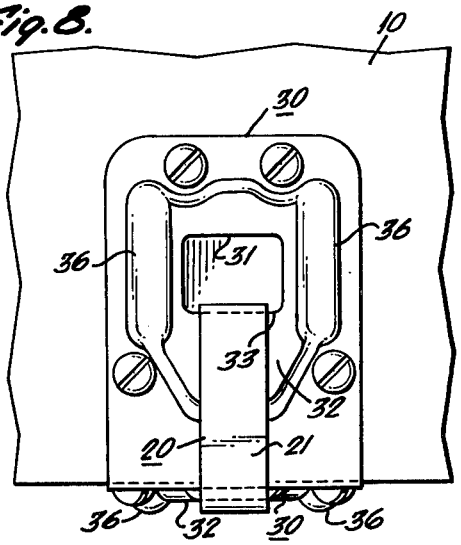
FIG. 8 is a top view of the fastening parts shown in FIG. 7.
Figure 7:
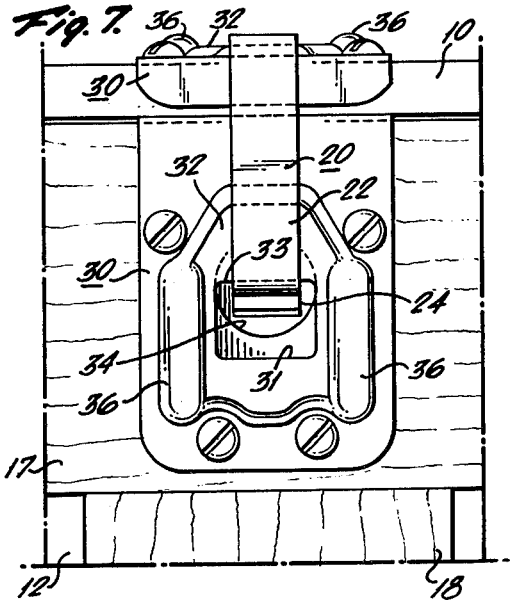
FIG. 7 is a detail view of a modification of the fastening parts, used for example, at points intermediate the corners of a panel structure.

The description will now be directed towards an explanation of the manner in which a corner is fastened together, with particular reference to FIGS. 4 through 6, 9 and 10. It should be recognized that certain important features of the assembly utilized for fastening the panels as shown in the above figures are also utilized in the fastening construction for points intermediate the corners as shown in FIGS. 7 and 8.

Figure 6:
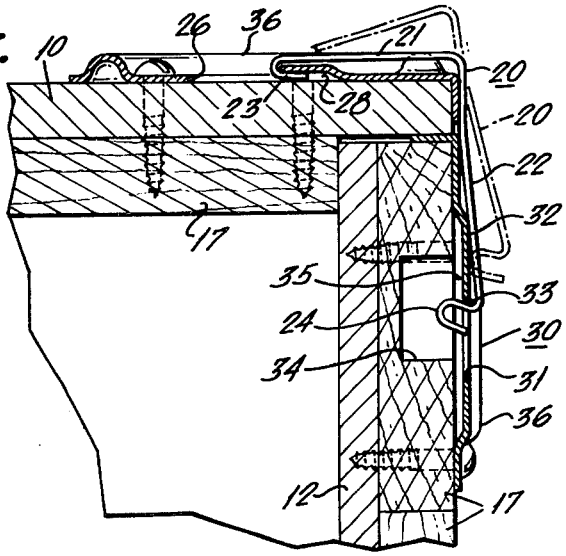
FIG. 6 is a sectional view taken along line 6—6 of FIG. 4.
Figure 9:
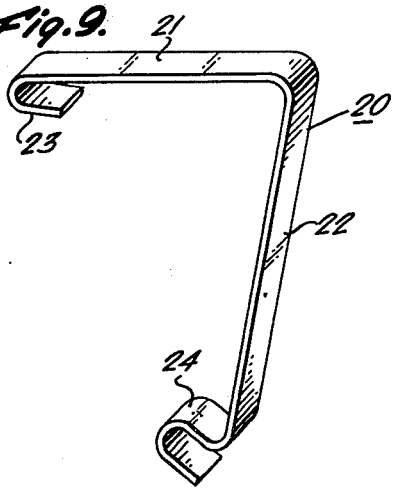
FIG. 9 is a detail view showing a preferred form of clip used in the system shown in FIGS. 4 and 7.
Figure 10:
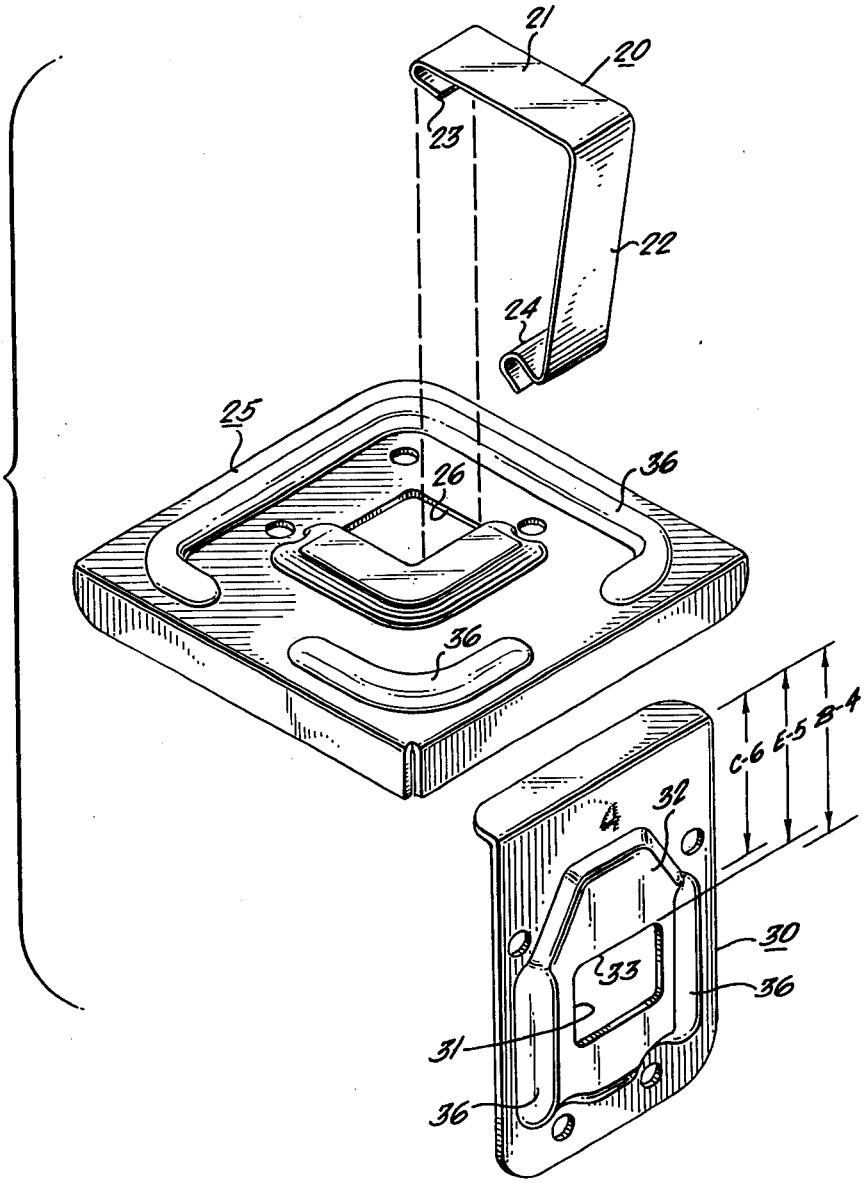
FIG. 10 is an exploded view of a portion of the assembly shown in FIGS. 4 through 6.

In the illustrative form of the invention, each corner is preferably secured by two spring clips 20 which hook onto the brackets on one panel and snap into openings in brackets mounted at opposite sides of the corner on the adjacent panels. The same type of clip is preferably also used for fastening the panels of the structure at points between the corners. As best shown in FIG. 9 in the illustrative form of the invention, each clip 20 is preferably bent so as to have two arms 21 and 22 which are angularly disposed with respect to one another so as to fit over the angular joint formed between panels. In FIG. 9, it can be seen that the end of arm 21 is preferably turned over so as to form a hook 23 which is adapted to fit within a slot in the bracket on one panel as described hereinafter. A detent or loop-like portion 24 is preferably preformed on the end of the arm 22 as shown in FIGS. 6, 9, 10. As shown in FIGS. 9 and 10, the angle between the arms 21 and 22 is preferably less than the joint angle formed by the panels at the joint when the clip is unflexed, although in certain installations, this angle may be larger than the angle formed at the joint edge when the clip is unflexed.

In carrying out the invention, the corner mounting brackets or plates 25 are secured to the top and bottom panels adjacent the corners of the structure. Each corner bracket 25 may be a stamping and is formed with a rectangular central opening 26 offset from the joint edges formed between the top and the side and end panels adjacent the corner. The portion of the bracket between the opening 26 and the joint edges is preferably raised so as to form with the surface of the panel, a slot-like space 28 (FIG. 6) extending towards the joint edges and within which the turned over hook portions 23 on the clips are adapted to fit.

A pair of brackets 30 are secured to the batten or frame members 17 on the side and end panels 12 and 13 at the corners, immediately beneath the corner brackets 25. Each bracket 30 has an opening 31 which preferably is formed in a raised, central portion 32. The edge of the opening which is closest to the joint edge, as indicated at 33, forms a detent retaining part for interengagement with the detent means of clip 20. Preferably, a clearance hole 34 is provided underneath the openings in the brackets where the detent parts interengage, so that when the detent parts are interengaged, there is adequate clearance for the detent part on the clip which fits around and under the edge 33. It should be noted that holes 34 are only provided behind the bracket openings which receive the detent parts 24. Since the brackets which receive the hook portions of the clips do not have holes provided beneath them, substantial time is saved in drilling these holes. Further, the holes need only be formed on side and end panels, so that rain-collecting holes on the top panels can be eliminated.

At points intermediate the corners and at other points where it is desired to secure angularly disposed panels along a single joint line, pairs of brackets 30 may be mounted on opposite sides of the joint edge. Beacuse of the raised central position in which the opening 31 is located in each of these brackets, a slot-like space 28 is provided for receiving the hook 23 on the end of clip 20.

As illustrated in FIGS. 4 through 8, the hook portions 23 on the clips 20 are first hooked into the slot-like openings in the mounting brackets 25 and 30 so that each clip fits around the joint to be formed by the panels. Preferably, the hook portions of the clips and the slots are dimensioned so that the parts fit relatively snugly within the slots 28. As a result of this snug fit, the clips will be held in proper position in the slots once they are hooked in place so that during assembly the panels may be turned over and shifted around as they are properly positioned relatively to one another without the clips falling from their slots. This advantage greatly simplifies and shortens the assembly operation, especially when containers with large heavy panels which are awkward to handle are being put together.

As can be seen in FIG. 6, when the hook end of a clip 20 is fitted within a slot 28 or 34 the clip is initially in the unflexed position and flexes partially to assume the approximate position shown in broken lines when the panels are placed in position in which they are to be locked together. Pressure applied to the detent end of the clip forces it inwardly and the clip flexes until detent portion snaps over the retaining edge 30 at which point the panels releasably lock together. In this position, the clip is in the full line position flush against the raised parts of the brackets shown in FIG. 6 and can only be removed by use of a crow bar, screwdriver or other prying tool.

In many types of structures as is the case with the household good containers shown in the drawings, the panels are formed of plywood of varying thickness so that the distance from the outer surface of the panel to the joint will vary. In order to compensate for this, it is preferred that the brackets 30 be formed with the openings 31 located at varying preselected distance from the joint edge so as to permit the use of a standard sized clip for joining all panels. By way of example, in standard household goods containers using panels of three different thicknesses ($\frac{3}{8}''$, $\frac{1}{2}''$ and $\frac{5}{8}''$) brackets having openings offset from the joint edge by $\frac{1}{8}''$ increments as identified by the dimensions C-6, E-5 and B-4 in FIG. 10, may be provided so as to accommodate the panels which vary in thickness by approximately $\frac{1}{8}''$ increments. Preferably, the brackets carry indicia such as the numeral 4 in FIG. 10 to indicate the thickness of the panel with which a particular bracket is to be used. By proper bracket selection, which is determined by the distance from the surface of one panel to the retaining edge 33 on the bracket on the adjacent panel, clips having arms of standardized lengths can be provided, even though panel thickness may vary considerably.

On both types of plates 25 and 30, embossments 35 are preferably provided. These embossments are raised sufficiently so as to provide protection against accidental dislodgement of the spring clips and to support the panels on the embossments rather than the springs when the interlocked panels are laid on a flat surface or are stored in abutting relationship with respect to one another.

Figure 5:
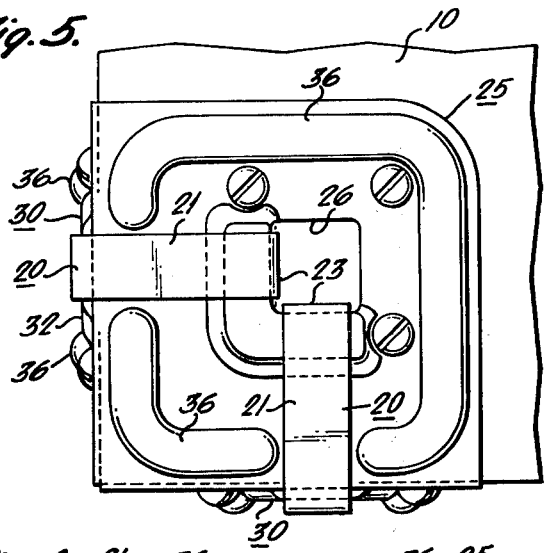
FIG. 5 is a top view of the fastening system shown in FIG. 4.
Figure 4:
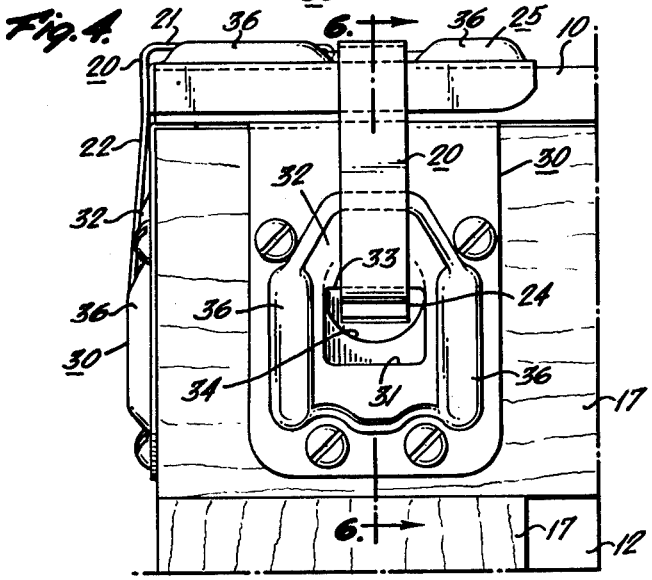
FIG. 4 is a detail view showing a fastening system provided at a corner of the structure shown in FIG. 1.

In summary, in assembling a structure consisting of multiple panels in angularly disposed relationship, the clip and bracket structure of FIGS. 4 through 6 may be used wherever three angularly disposed panels are joined together. Where additional fasteners are required as in large containers, the assembly of FIGS. 7 and 8 is provided at one or more points intermediate the corners as illustrated in FIGS. 1 through 3.

The invention provides a simple and effective means for the assembly of crates or other box-type enclosures, temporary buildings, concrete forms and other multipanelled structures formed of wood, metal or other materials. The brackets are readily secured to the panels by any suitable means such as screws, bolts, blind fasteners or the like. Once mounted on the panels, they form permanent anchor points for the spring clips which can be quickly locked in place so as to secure the panels together. Clips formed according to the invention resist unintentional dislodgement, as there are no projecting parts when they are snapped into place. A structure fastened together using the invention can be quickly disassembled, using any prying tool and the panels stacked for storage and shipping until reuse is required.

What is claimed is:

1. A fastening system for securing panels angularly positioned adjacent one another and forming a joint, said system comprising a resilient spring clip, being prebent into two angularly disposed arms adapted to fit exteriorly of the joint, the bend angle between the arms being different from the angle of the panels forming the joint when the clip is unflexed, the arms being capable of flexing to positions in which the bend angle is substantially the same as the angle of the joint when the clip is flexed so that the clip fits around the joint, first plate means mounted on the exterior surface of one of said panels, said first plate means having a portion which is raised relative to the panel surface adjacent the joint, said raised portion defining a slot running parallel to the surface of the panel and having an opening for access to the slot offset from the joint edge, second plate means on the adjacent panel having a portion defining a clip retaining edge offset from the joint edge, said clip having the end of one arm provided with a 180° bend to form an elongated hook which runs parallel to the arm of the clip, said hook being adapted to enter the slot formed between the raised portion and the exterior surface of the panel through said opening, the hook forming end and the one arm being spaced apart relatively to the thickness of the raised portion and the hook being of a thickness relative to the slot to cause the hook and arm of the clip to interfit with the raised portion and the clip to be substantially non-movably retained in place relatively to the slot with the one arm extending substantially parallel to the surface of the first plate means as the panels are moved into position to be joined together, said clip having detent means projecting inwardly from the end of the other arm, said arm being held in the position in which the clip fits around the joint upon flexure thereof and the detent means resiliently interengages with said retaining edge on said second plate, said hook and slot further coacting to prevent accidental dislodgement of the clip during use of the container and during removal of the detent means from the retaining edge of the second plate.

2. A fastening system according to claim 1 further including a recess formed in the said adjacent panel underlying said retaining edge to provide for clearance for the detent end of said clip.

3. A fastening system according to claim 1 further including support ridges on said plates, said support ridges being spaced apart and being raised relatively to the plate surface to support the structure and to allow a clearance space for said clip when a fastened panel is resting on a support surface or an adjacent structure.

4. In a fastening system for joining adjacent panels along a joint line wherein the panels abut one another and the abutting edges are of a plurality of different thicknesses, said system comprising resilient flat clips, said clips each being shaped to form two angularly disposed arms, the end of one of said arms having a bend of substantially 180 degrees to form a clip retaining hook, means forming a slot-like opening on one of said panels, said opening having a portion running adjacent to and parallel to the exterior surface of said one panel for receiving and retaining said clip retaining hook whereby the clip is held within the slot against substantial movement relative to the panel with the hook-carrying arm being held adjacent to the surface of said panel during shifting movement of the panel into position adjacent another panel, a detent means projecting inwardly of the end of the other arm of the clip, means defining a detent retaining edge on the other panel, a recess in said other panel beneath said retaining edge for receiving said detent means, said detent means being adapted to resiliently interengage with said retaining edge when the clip is flexed whereby said panels are held together, said hook and slot further coacting to prevent dislodgement of the hook from the slot during disengagement of the detent means of the other arm of the clip and means permitting the use of a single size of clip despite said different panel thicknesses which comprise plural plates on which said detent retaining edges are formed, said plated being selectively secured to said other panel forming a joint with one edge abutting said joint line, each said plate having its detent retaining edge offset from said joint line by a predetermined amount according to the thickness of the adjacent panel, and indicia on said plural plates representative of the amount of offset from the joint line whereby through selection of the appropriate indicia bearing plate a constant distance between the top of the adjacent panel and the detent edge is maintained.

* * * * *